United States Patent [19]

Loui et al.

[11] 4,037,813

[45] July 26, 1977

[54] SHELF SUPPORT

[75] Inventors: Phillip J. Loui, Chicago; James A. Schmidt, Jr., Berwyn, both of Ill.

[73] Assignee: Handy Button Machine Company, Chicago, Ill.

[21] Appl. No.: 693,355

[22] Filed: June 7, 1976

[51] Int. Cl.[2] ..... A47B 57/04

[52] U.S. Cl. ..... 248/250; 108/110; 211/191

[58] Field of Search ..... 248/235, 241, 250, 507, 248/500; 211/191, 192, 193; 108/96, 97, 107, 110

[56] References Cited

U.S. PATENT DOCUMENTS

| | | | |
|---|---|---|---|
| 813,838 | 2/1906 | Steinberg | 24/230 SC |
| 1,499,428 | 7/1924 | Wagner | 24/230 SC |
| 1,590,400 | 6/1926 | Widmer | 24/230 SC |
| 2,591,009 | 4/1952 | Riche | 24/230 SC X |
| 3,463,427 | 8/1969 | Fisher | 248/74 PB X |
| 3,471,111 | 10/1969 | MacDonald | 248/250 X |
| 3,471,112 | 10/1969 | MacDonald et al. | 248/250 X |
| 3,489,136 | 1/1970 | Bucellato | 248/250 X |
| 3,581,349 | 6/1971 | Verspieren | 248/74 PB |
| 3,601,431 | 8/1971 | Henley | 24/230 SL X |
| 3,873,759 | 3/1975 | Schindler | 220/284 X |

FOREIGN PATENT DOCUMENTS

| | | | |
|---|---|---|---|
| 1,580,374 | 9/1969 | France | 248/250 |

*Primary Examiner*—J. Franklin Foss
*Attorney, Agent, or Firm*—Olson, Trexler, Wolters, Bushnell & Fosse, Ltd.

[57] ABSTRACT

A one-piece plastic shelf support has a back portion with a shelf-receiving flange projecting from one side thereof and a stem projecting from the other side thereof. The back portion also includes adjacent sections that form an obtuse angle with a shoulder at the vertex of the angle and presented toward the flange. The aforesaid adjacent sections yield resiliently and flatten out as the shelf edge portion is snapped past the shoulder to seat on the flange, whereby the shelf edge portion is confined between the flange and the shoulder.

6 Claims, 6 Drawing Figures

SHELF SUPPORT

BACKGROUND OF THE INVENTION

This invention relates to improvements in shelf supports of the type primarily intended for supporting shelves between opposed uprights, for instance cabinet walls or walls at the ends of bookcases. Prior art shelf supports of the foregoing general type are shown and described in U.S. Pat. Nos. 3,471,111 and 3,471,112. Shelf supports of the type with which the present invention is concerned are particularly suitable for shipping shelves in cabinets with the shelving mounted in place. Nevertheless, the user of the cabinet can conveniently remove and remount the supports and the shelves in different positions so as to vary the shelf spacing.

OBJECTS AND SUMMARY OF THE INVENTION

An object of this invention is to provide a one-piece plastic shelf support which embodies adjacent sections containing a shoulder that cooperates with a flange spaced from the shoulder to retain a shelf edge portion therebetween. These adjacent sections are resilient and permit the shoulder to be displaced as the edge of the shelf snaps therepast to position the shelf edge between the shoulder and the flange.

A further object of this invention is to provide a shelf support having the characteristics set forth in the preceding paragraph and in which the shelving tends to be substantially "self-centered" when mounted in the cabinet. This self-centering action is accomplished by the engagement or near engagement of the opposite ends of the shelf with the aforesaid adjacent sections of two opposed supports, respectively, which in some cases remain resiliently depressed or flexed to a limited degree. Even where there is "end play" in the shelf, it tends to be slight.

In accordance with the foregoing objects the foregoing shelf supporting member has a back portion with a first section, a second section, and a third section. The sections are contiguous in end-to-end relationship. A flange projects from one side of the back portion to provide a support for an edge portion of the shelf. The flange is substantially at the junction of the first and second sections. A stem projects from the opposite side of the first section for engagement in an opening in the cabinet wall or other upright structure. The second and third sections are resilient and form an obtuse angle with a shoulder being substantially at the vertex of that obtuse angle and being presented toward the flange and being spaced therefrom to cooperate with the flange for retaining the shelf edge portion therebetween. The second and third sections tend to flatten within elastic limits and increase the angle between them as the shelf edge portion is moved over the third portion and past the shoulder, whereupon the second and third sections snap back to cause the shoulder to overlie said shelf edge portion.

Preferably, the third section tapers from the shoulder toward that end of the third section that is remote from the vertex. Furthermore, the first section is planar and the aforesaid vertex is offset from the plane of the first section in the direction toward which the flange projects. Also, the foregoing first and second sections form a further obtuse angle with the vertex of that angle being substantially at the junction of the first section, the second section and the flange.

DETAILED DESCRIPTION

Figure 1:
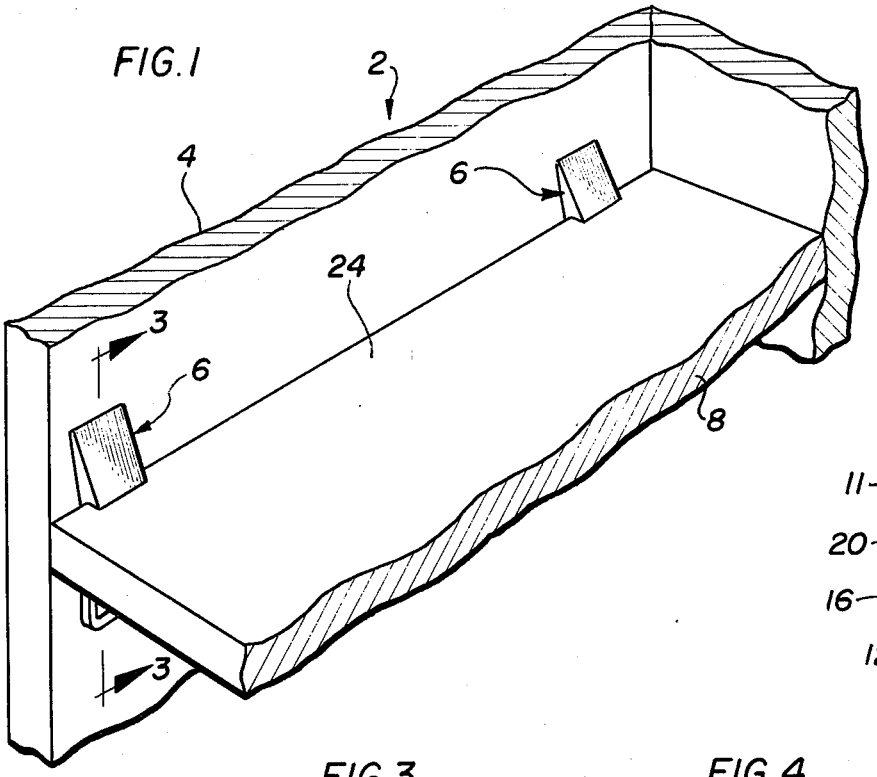
FIG. 1 is a fragmentary perspective view of a cabinet or like structure that utilizes a shelf support constructed in accordance with and embodying the present invention.
Figure 2:
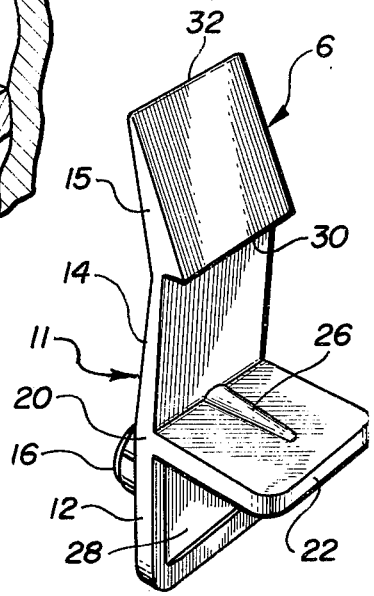
FIG. 2 is a perspective view of the shelf support.

Referring now in more detail to the drawing there is shown a cabinet, bookcase or like structure 2 having a wall or upright 4 that receives one or more shelf supports 6 of the type with which the present invention is concerned. It will be understood that the cabinet 2 is of conventional construction and includes at its opposite end an upright or wall that is parallel to and similar to the upright 4, also for mounting one or more of the shelf supports 6. A shelf 8 is supported at its opposite ends by one or more of the supports 6 mounted on each of the opposite walls 4 of the cabinet 2. The cabinet 2 usually comprises a plurality of such shelves 8, and the shelf supports 6 may be mounted in various positions so as to support the various shelves in different spaced relationship, according to the needs of the user. Accordingly, the upright 4 has one or more series of vertically spaced holes or apertures for accommodating the shelf support 6, one such hole being indicated in 10 in FIGS. 3 and 4.

This shelf support 6 is a one-piece plastic member which may be formed of a molded polypropylene plastic. The shelf support 6 comprises a back portion 11 which is adapted for disposition against the inside surface of the upright 4. The back portion 11 comprises a lower first section 12, an intermediate second section 14, and an upper third section 15, the sections 12, 14, 15 being in contiguous end-to-end relationship.

The first section 12 is of planar construction and is normally flush against the upright 4. A stem 16 is formed on the first section 12 and projects rearwardly thereof and generally perpendicular thereto. This stem 16 is sized to fit snugly but removably into the hole 10 so as to secure the support 6 to the upright 4. The stem 16 may have circumferentially spaced, longitudinal ribs 18 to enhance the frictional grip of the stem 16 with the material that defines the wall of the hole 10.

The first section 12 and the second section 14 meet at a junction 20, which constitutes the vertex of an obtuse angle that is formed by the first and second sections 12,14. Projecting forwardly from this vertex or junction 20 and substantially at right angles to the first section 12 is a flange 22 upon which the edge portion 24 of the shelf 8 is adapted to rest. A forwardly projecting raised rib 26 is on the upper surface of the flange 22 so as to enhance the engagement between the flange 22 and shelf edge portion 24. Reinforcing gussets 28,28 may be extended between the first section 12 and the flange 22 to increase the load-carrying capacity of the latter.

The second section 14 and the third section 13 also form an acute angle having a vertex substantially at a shoulder 30. This shoulder is spaced from the flange 22 a distance which is approximately the thickness of the shelf 8.

It will be noted that the second section 14 tapers toward the junction with the third section 15, the latter having its widest dimension at the shoulder 30 tapering upwardly to a very thin edge 32 which abuts the upright 4. This leaves a generally triangular gap defined by the sections 14,15 and the wall 4. The thin junction between the sections 14,15 i.e. adjacent to the shoulder 30 provides a rather resilient region that enhances the resilient yieldability of the structure.

Figure 3:
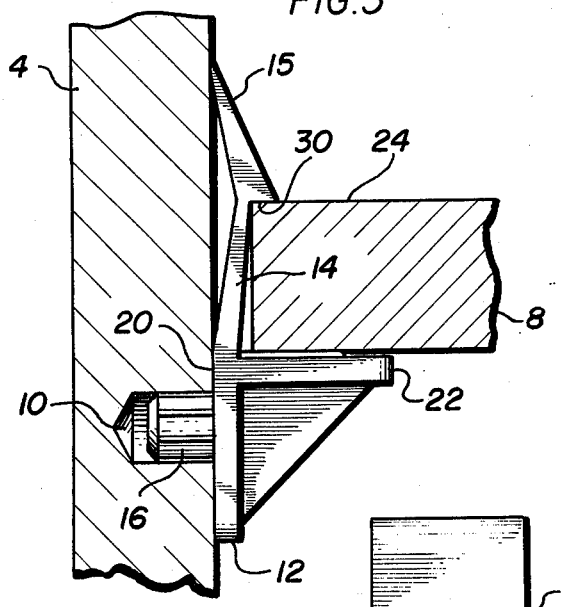
FIG. 3 is a fragmentary sectional view, on an enlarged scale, taken along line 3—3 of FIG. 1.
Figure 4:
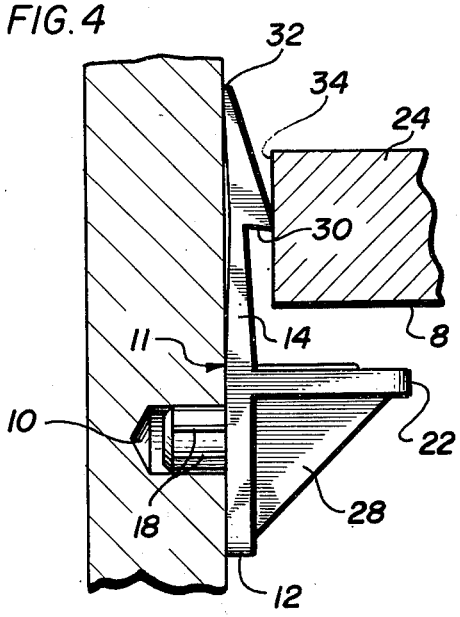
FIG. 4 is a fragmentary sectional view similar to FIG. 3 and showing the edge portion of a shelf just prior to being moved into its final position on the support.
Figure 5:
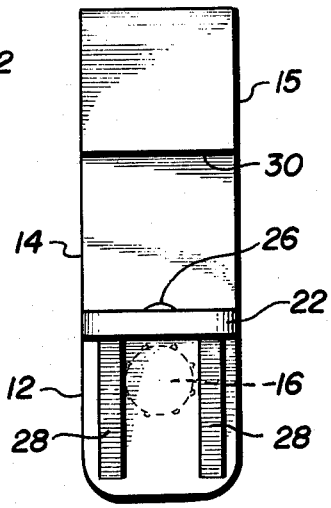
FIG. 5 is a front elevational view of the shelf support.

The shelving has a length which is substantially equal to or slightly less than the distance between the sections 14 of two opposed supports 6 on opposite walls of the cabinet. This insures that the shoulder 30 will extend over the tip of the edge portion 24 at each end as shown in FIGS. 1 and 3 with respect to one shelf end. In any event, the shelf 8 is mounted onto one or more of the supports 6 by passing the extreme end surface 34 past the section 15 and across the shoulder 30, as shown in FIG. 4. This causes the sections 14,15 to flatten out, thereby enabling the end surface 34 to pass across the shoulder 30. When the bottom surface of the shelf edge 24 reaches the rib 26 the sections 14,15 resiliently flex to allow the shoulder 30 to snap into overlying relation with the edge 34, as shown in FIG. 3. The shelf is now retained in place. Furthermore, endwise movement of the shelf tends to be restrained or at least kept to a mimimum because end play of the shelf is resisted by the resiliency of the sections 14,15.

Removal of the shelf is facilitated by forcefully pushing the shelf endwise so that one end of the shelf clears the shoulder 30. Then that end of the shelf can be lifted past the shoulder 30.

Figure 6:
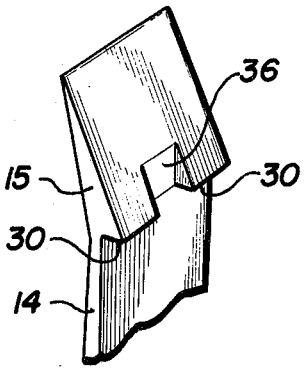
FIG. 6 is a fragmentary perspective view of the upper end of a modified form of a shelf support in accordance with the invention.

In FIG. 6 there is shown a modified form of the invention in which the shoulder extends across section 15 only partially, being interrupted by a tool-reaching slot 36. A screw driver or like tool may be inserted into the slot 36 to depress the shoulder 30 out of engagement with the shelf when it is desired to remove the shelf from the cabinet.

The invention is claimed as follows:

1. A one-piece plastic member for supporting an edge portion of a shelf on an upright and wherein the upright has at least one opening therein, comprising a back portion having a first section, a second section and a third section, said sections being contiguous and in end-to-end relationship, at least one of said first and second sections having a region for engagement with said upright, a flange projecting from one side of said back portion to provide a support for the edge portion of the shelf, said flange being substantially at the junction of said first and second sections, a stem projecting from the opposite side of said first section for engagement in said opening, said second and third sections being resilient and forming an obtuse angle, a shoulder substantially at the vertex of said obtuse angle and being presented toward said flange and being spaced therefrom to cooperate with said flange for retaining the said shelf edge portion therebetween, said second and third section tending to flatten within elastic limits and increase said angle as the shelf edge portion is moved over said third portion and past said shoulder, whereupon the second and third sections snap back to cause the shoulder to retain said shelf edge portion, a portion of the third section remote from said shoulder having a region for engagement with said upright such that two regions are respectively above and below the shelf when the latter is on said flange.

2. A one-piece plastic member according to claim 1 in which said third section tapers from said shoulder toward that end of the third section that is remote from said vertex.

3. A one-piece plastic member according to claim 1 in which said first section is planar and said vertex is offset from the plane of said first section in the direction toward which said flange projects.

4. A one-piece plastic member according to claim 3 in which said first and second sections form an obtuse angle with the vertex thereof being substantially at the junction of said first and second sections.

5. A one-piece plastic member according to claim 1 in which said shoulder extends for the full width of the third section.

6. A one-piece plastic member according to claim 1 in which the shoulder extends across part of the third section but is interrupted by a tool-receiving slot.

* * * * *